US009263820B2

(12) United States Patent
Mattiuzzo

(10) Patent No.: US 9,263,820 B2
(45) Date of Patent: Feb. 16, 2016

(54) ELECTRICAL PRESS-FIT PIN FOR A SEMICONDUCTOR MODULE

(71) Applicant: Vishay General Semiconductor LLC, Hauppauge, NY (US)

(72) Inventor: Emilio Mattiuzzo, San Maurizio Canavese (IT)

(73) Assignee: Vishay General Semiconductor LLC, Hauppauge, NY (US)

( * ) Notice: Subject to any disclaimer, the term of this patent is extended or adjusted under 35 U.S.C. 154(b) by 0 days.

(21) Appl. No.: 14/154,804

(22) Filed: Jan. 14, 2014

(65) Prior Publication Data

US 2014/0199861 A1 Jul. 17, 2014

Related U.S. Application Data

(60) Provisional application No. 61/752,278, filed on Jan. 14, 2013.

(51) Int. Cl.

| | |
|---|---|
| ***H01R 12/00*** | (2006.01) |
| ***H01R 13/415*** | (2006.01) |
| *H01R 43/26* | (2006.01) |
| *H01R 12/58* | (2011.01) |

(52) U.S. Cl.

CPC ..... *H01R 13/415* (2013.01); *H01R 12/585* (2013.01); *H01R 43/26* (2013.01); *Y10T 29/49147* (2015.01)

(58) Field of Classification Search

CPC ..... H01R 13/426; H01R 12/00; H01R 19/26; H01R 19/22; H05K 3/4092

USPC ..... 439/81, 709

See application file for complete search history.

(56) References Cited

U.S. PATENT DOCUMENTS

| | | | | |
|---|---|---|---|---|
| 6,312,296 | B1 * | 11/2001 | Jones | H01R 12/585 439/733.1 |
| 6,719,573 | B2 | 4/2004 | Koehler et al. | |
| 6,997,727 | B1 | 2/2006 | Legrady et al. | |
| 7,780,483 | B1 * | 8/2010 | Ravlich | H01R 12/585 439/751 |
| 2007/0270001 | A1 * | 11/2007 | Matsumura | H01R 12/585 439/82 |
| 2009/0197439 | A1 * | 8/2009 | Nabilek | H01R 12/585 439/82 |
| 2010/0062649 | A1 * | 3/2010 | Wu | H01R 12/82 439/636 |
| 2012/0295490 | A1 * | 11/2012 | Schneider | H01R 12/91 439/709 |

FOREIGN PATENT DOCUMENTS

| | | |
|---|---|---|
| GB | 1049435 | 11/1966 |
| JP | 11-233216 A | 8/1999 |

OTHER PUBLICATIONS

Extended European Search Report in corresponding EP application (14 738 326.9) dated Dec. 7, 2015, 6 pages.

* cited by examiner

*Primary Examiner* — Abdullah Riyami
*Assistant Examiner* — Nader J Alhawamdeh
(74) *Attorney, Agent, or Firm* — Stuart H. Meyer; Mayer & Williams PC

(57) ABSTRACT

An electrical module includes a housing, at least one electrical component mounted within the housing and an electrical press-fit contact. The electrical press-fit contact is located in part within the housing and has a press fit portion and a stop portion at its distal end and a mounting portion at its proximal end. The mounting portion is electrically coupled to the electrical component. The press-fit portion is located exterior of the housing such that the stop portion is able to block movement of the press-fit section into the housing when a press-in force is introduced onto the press-in contact to press the press-fit contact into the housing.

21 Claims, 7 Drawing Sheets

ELECTRICAL PRESS-FIT PIN FOR A SEMICONDUCTOR MODULE

STATEMENT OF RELATED APPLICATION

This application claims the benefit of U.S. Ser. No. 61/752,278, filed Jan. 14, 2013 which is hereby incorporated by reference in its entirety.

BACKGROUND

Press-fit interconnect technology is known in the art for mechanically and electrically connecting a module to a printed circuit board or other conductive plate. The connection is formed using terminal pins that extend from the module. The terminal pins have compliant sections or portions (sometimes called press-fit pins) which are designed to be inserted into a plated-through hole in the printed circuit board or other conductive plate. In this way an electro-mechanical connection is established between the pins and the printed circuit board without the use of solder.

The pin generally includes a mating portion adapted to contact an electrically conductive element within the module and a compliant portion extending from the mating portion and adapted to make electrical contact with conductive material defining the interior surface of the plated-through hole of the printed circuit board. The compliant portion is generally configured with one or more hinge areas that bend or flex as the pin is inserted in the hole, allowing the pin to compress to fit into the hole. The pin is thereby retained within the hole by frictional engagement between the pin and the hole walls, creating a solder-free electrical connection between the pin and the conductive interior surface of the hole.

Among its advantages, press-fit technology is highly reliable, fast, cost-effective and not subject to quality problems associated with solder such as cold spots, voids splatter and cracks. In addition, no thermal stress is placed on the printed-circuit board and press-fit parts can be readily customized to enable package designers to meet their manufacturing targets. Press-fit technology is used in a wide range of industries including telecommunications and automotive with a concomitant variety in the types of modules to which it is applied. For example, modules that may employ press-fit technology may be used to transport signals or power and include, for example, PCB-to-PCB stacking interconnects, fuse holders, smart junction boxes, motor and power controllers, lighting and so on.

SUMMARY

In accordance with one aspect of the invention, an electrical module includes a housing, at least one electrical component mounted within the housing and an electrical press-fit contact. The electrical press-fit contact is located in part within the housing and has a press fit portion and a stop portion at its distal end and a mounting portion at its proximal end. The mounting portion is electrically coupled to the electrical component. The press-fit portion is located exterior of the housing such that the stop portion is able to block movement of the press-fit section into the housing when a press-in force is introduced onto the press-in contact to press the press-fit contact into the housing.

In accordance with another aspect of the invention, a method is provided for assembling an electrical module having at least one press-fit contact. The method includes mechanically and electrically securing a press-fit electrical contact to a mounting surface of a carrier portion of a housing.

The carrier has at least one electrical component secured therein. The press-fit contact has a press-fit portion and a stop portion at its distal end and a mounting portion at its proximal end. The mounting portion is electrically coupled to the electrical component. The distal end of the press-fit contact is inserted through a through-hole located in a surface of a second portion of the housing that mates with the carrier portion to form an interior space therein such that the press-fit portion is located exterior of the housing and at least the mounting portion is located in the interior of the housing. A rotational force is applied to at least the press-fit portion of the press-fit contact so that the stop portion is able to block movement of the press-fit section back through the through-hole in the surface of the housing when a press-in force is introduced onto the distal end of the press-in contact.

DETAILED DESCRIPTION

Figure 1:
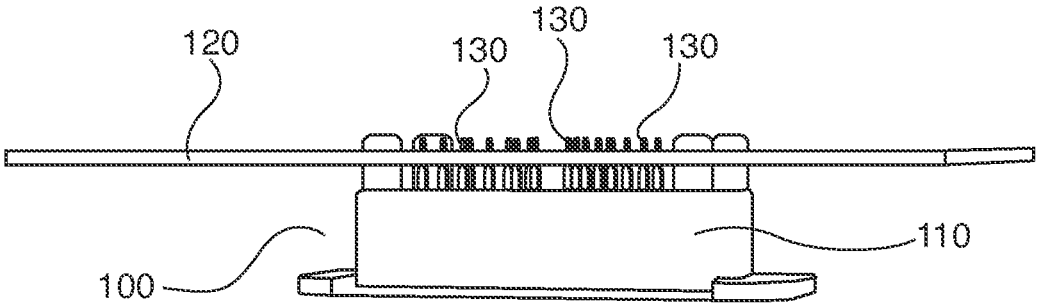
FIG. 1 is a side view of an electrical module electrically and mechanically connected to a substrate such as a printed-circuit board.

FIG. 1 is a side view of an electrical module 100 electrically and mechanically connected to a substrate 120 such as a printed-circuit (PC) board or other surface using press-fit technology. The module includes a housing 110 from which extends one or one or more press-fit pins 130. For purposes of illustration, three press-fit pins are shown in FIG. 1. However, the present invention contemplates an electrical module having any number of press-fit pins. The press-fit pins 130 each extend through a through-hole (not shown in FIG. 1) in the substrate 120.

Electrical module 100 may be any type of module, including but not limited to a power supply module, IGBT module, transistor module, diode module and so on. The retention of the electrical module 100 on the substrate 120 is obtained from the deformation of the pins into the through-holes of the substrate (hereinafter referred to as a PC board for purposes illustration).

Figure 2:
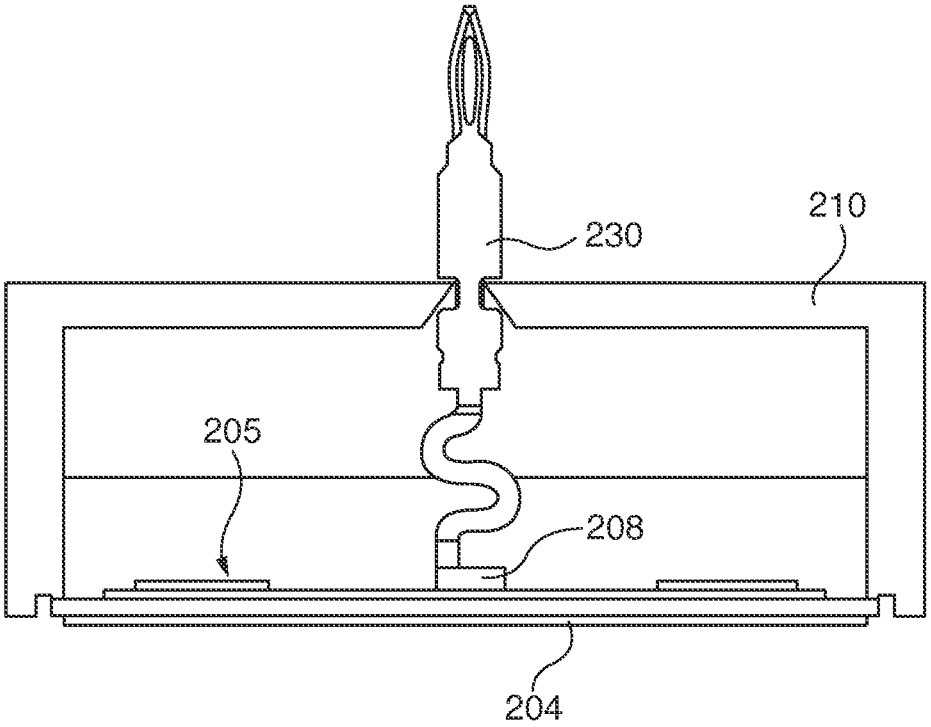
FIG. 2 shows a cross-sectional view through a simplified example of an electrical module such as shown in FIG. 1.

FIG. 2 shows a cross-sectional view through a simplified example of an electrical module such as shown in FIG. 1. For simplicity only a single press-fit pin 230 is shown. The housing 210 may be injection-molded onto or around the press-fit pin 230. The press-fit pin 230 is mounted onto a mounting section 208 of a carrier 204 and makes an electrical connection thereto using, for example, solder, conductive adhesive or the like. Likewise, carrier 204 includes one or more mounting platforms 205 on which one or more electrical components (not shown) are electrically and mechanically connected. The carrier 204 may be secured to the housing 210 using any suitable type of fastener or connector such as screws, for example. Alternatively, housing 210 and carrier 204 may be formed as an integral unit by overmolding or the like.

Figure 3:
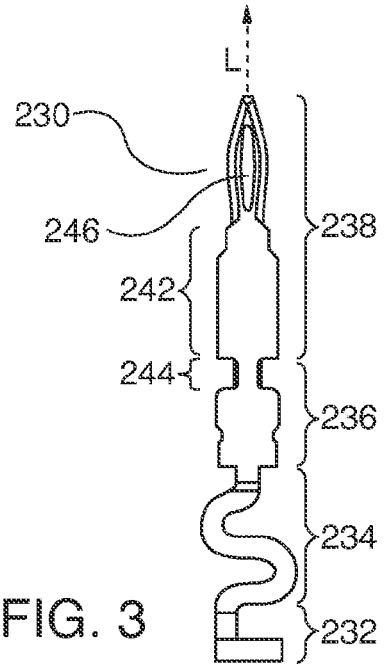
FIG. 3 shows one embodiment of a press-fit pin.

As shown more clearly in FIG. 3, in one embodiment press-fit pin 230 typically includes a press-fit portion 238, a shoulder portion 242, a transition portion 236, a relief portion 234 and a mounting portion 232. Dimensions of the press-fit pin 230 are determined to a large extent by a size and shape of the printed circuit board and components, such as connectors, applied to the printed circuit board.

The respective portions of the press-fit pin 230 pass into one another continuously and form a press-in pin which may be configured as one piece in terms of material. The press-fit pin 230 may be formed as a stamping/bending part and comprises an electrically conductive material which exhibits good spring characteristics. The electrical press-fit pin 230 may be any desired electrical contact element which is e.g., formed as an electrical press-in pin and is not limited to the particular shape or configuration shown in FIG. 3.

The press fit portion 238 of the press-fit pin 230 is tapered and extends from a distal end of the press-fit pin 230 toward the proximal end at which the mounting portion 232 is located. The press fit portion 238 comes in frictional contact with the inner surface of the through-hole located in the printed circuit board, allowing the press-fit pin 230 itself to be fixed. To this end, the press fit portion 238 is configured to be elastically deformable in the transverse direction substantially perpendicular to the longitudinal axis L of the press-fit pin 230. The dimensions of the press fit portion 238 are selected to be slightly larger than a diameter of the through-hole. In this particular embodiment, a slit (e.g., a needle eye) 246 is formed in a portion to be the press fit portion 238 in a longitudinal direction L, and the portion having the slit 246 is expanded outward, causing the press fit portion 238 to be elastically deformable in the traverse direction.

The shoulder portion 242 is disposed at the proximal end of the press-fit portion 238. The shoulder portion 242 extends outward in transverse direction beyond the width of the press fit portion 238. The shoulder portion 242 prevents the press-fit pin 230 from passing through the through-hole of the printed circuit board, engaging with the opening of the through-hole, even if an excessive insertion force is applied to the press-fit pin 230.

The transition portion 236 extends in the proximal direction from the proximal end of the shoulder portion 242. At least a section of the transition portion 236 defines a twistable portion 244 that extends from the proximal end of the shoulder portion 242. As shown, the twistable portion 236 is relatively narrow in the transverse direction in comparison to the width of the shoulder portion 242 in the transverse direction. In particular, the width of the twistable portion 244 in the transverse direction is sufficiently small so that it can be twisted about the longitudinal axis of the press-fit pin 230 while the mounting portion 232 remains fixed in place. That is, the twistable portion 244 has an elastic or malleable characteristic that allows it to twist without breaking when a torque is applied around the longitudinal axis of the press fine pin 230.

The stress relief portion 234 extends in the proximal direction from the proximal end of the transition portion 236. The stress relief portion 234, which in some embodiments is configured as one or more bends such as an S-shaped bend, provides a degree of elasticity or flexibility in order to compensate for forces arising due to external influences, such as thermal elongations, dimensional tolerances and/or mounting tolerances. This compensating portion prevents excessively large forces from acting on the electrical connection established by the press-fit pin 230. Other shapes of stress relief portion 234, such as a C-Shape, may perform in a similar manner.

The mounting portion 232 is at the proximal end of the press-fit pin 230 and serves as a base for establishing electrical contact with the mounting section 208 of the carrier 204 using, for example, solder, conductive adhesive or the like.

Figure 4:
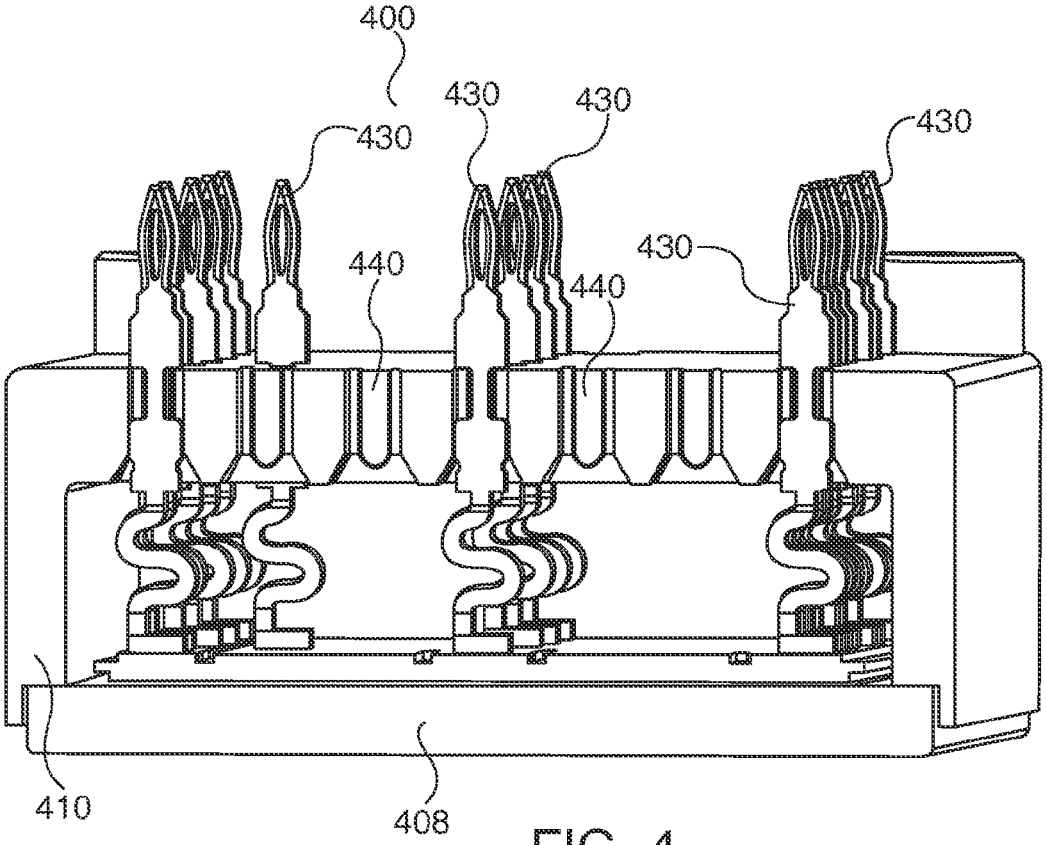
FIG. 4 shows a cross-sectional perspective view through one example of a completed electrical module such as the electrical module shown in FIG. 1.

FIG. 4 shows a cross-sectional perspective view through one example of a completed electrical module 410 such as electrical module 100 shown in FIG. 1. In this non-limiting example the press-fit pins employed are similar to the press-fit pins 230 shown in FIG. 3. As shown, the module 410 includes a housing 410 having through-holes 440 through which the press-fit pins 430 respectively extend. The proximal ends of the press-fit pins 430 are mechanically and electrically connected to mounting sections of carrier 408. The carrier 408, in turn is secured to the housing 410 to define an interior space in which the portions of press-fit pins 430 other than the press-fit portion 238 and shoulder portion 242 (see FIG. 3) are located. As shown, the press-fit portions 238 and the shoulder portions 242 extend from the exterior of the electrical module 410 to the exterior so that they can be secured to a PC board or other substrate. The interior space of the electrical module 410 may be filled with a gel or other substance to protect the internal structure of the module from the external environment.

Figure 5:
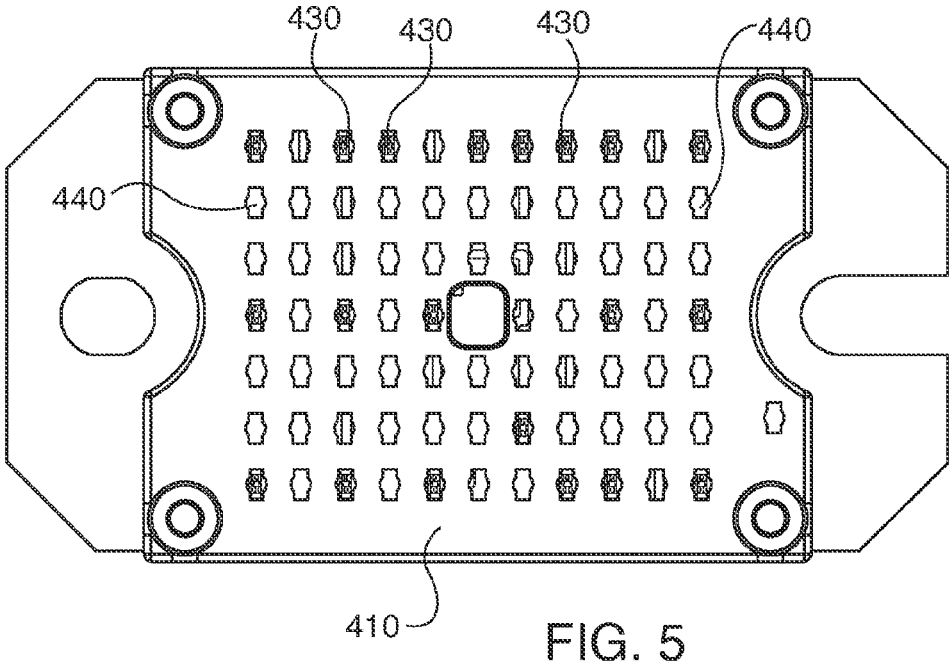
FIG. 5 is a top view of the electrical module shown in FIG. 4.
Figure 6:
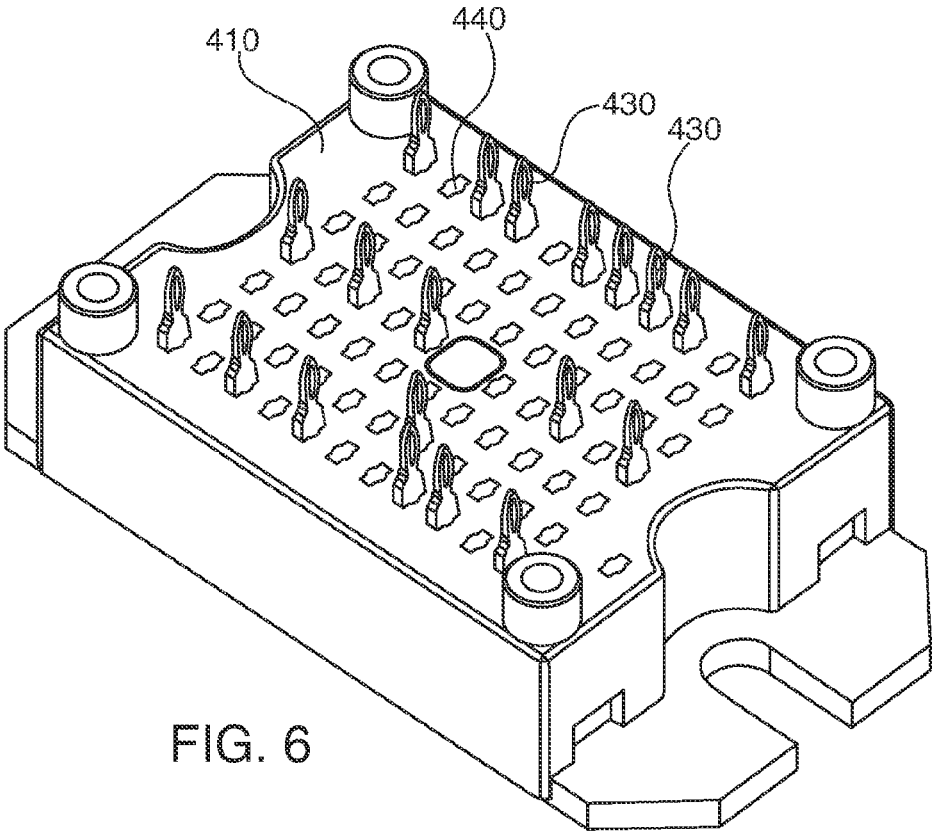
FIG. 6 is a perspective view of the electrical module shown in FIG. 4.

FIG. 5 is a top view and FIG. 6 is a perspective view of the electrical module 410 shown in FIG. 4, which shows the through-holes 440 located in the housing 410 and the press-fit pins 430 disposed therein. As shown, the cross-section through the through-holes 440 has a non-circular shape that allows at least the distal end (e.g., the press-fit portion 238, the shoulder portion 242 and transition portion 236) of the press-fit pin 440 to pass through the through-hole 440 in only a single orientation. That is, in this example, the through-holes 440 can only accommodate the press-fit pins 430 when there is only a single rotational orientation of the press-fit pins 430 about their longitudinal axes for which the maximum width of the shoulder portions 242 in the transverse direction is aligned with the maximum cross-sectional width of the through-holes 440.

More generally, the through-holes and the press-fit pins are configured with respect to one another so that at least the distal end of the pins will pass through the holes only when the pins are rotated about their longitudinal axes into any of a limited number of positions and will be prevented from passing through the hole when rotated into other positions because the shoulder portion of the pin contacts the surface in which the through-hole is formed, thereby preventing the press-fit pin from passing any further through the through-hole. Accordingly, the shoulder portion 242 more generally may be configured in any way that allows it to serve as a stop portion which prevents the more distal end of the press-fit pins from passing through the through-holes 440 and into the housing when an insertion force is applied to the press-fit pin.

Figure 7:
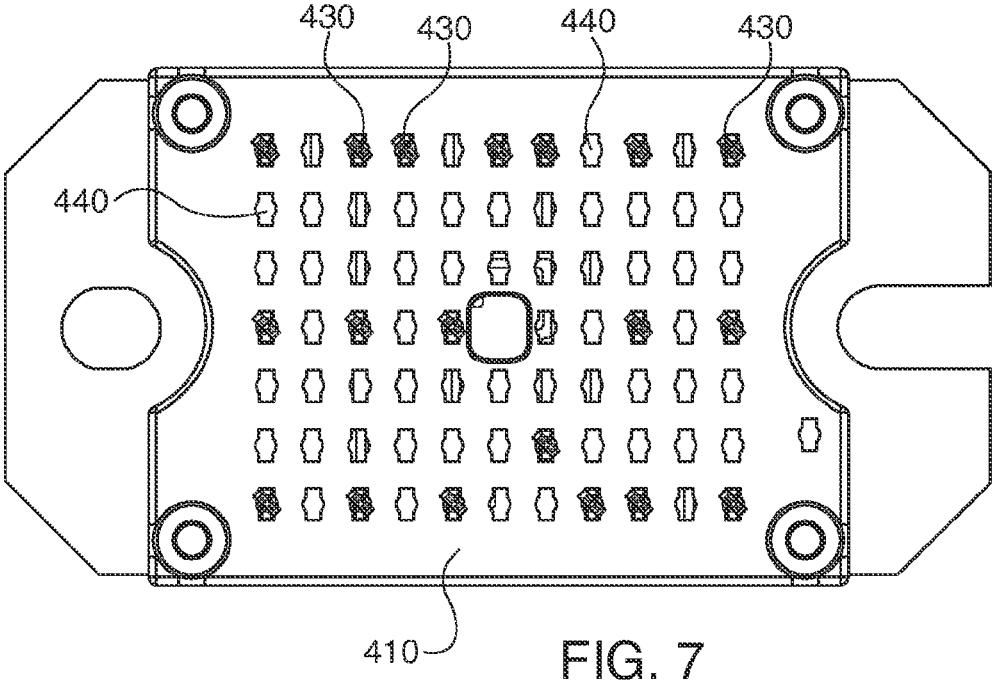
FIG. 7 show press-fit pins rotated into a position which prevents them from extending any further into their corresponding holes.

FIG. 7 shows the press-fit pins 430 rotated into a position in which their respective shoulder portions prevent the pins 430 from extending any further into the holes 440. Stated differently, the press-fit pins 430 and the through-holes 440 have complementary geometric shapes so that one fits through the other in accordance with a "lock and key" model.

FIGS. 8-11 show one method that may be employed for assembling the electrical module 400 described above. First, in FIG. 8, press-fit pins 430 have been mechanically and electrically secured to the carrier 408. In one embodiment, the carrier 408 may be formed from a Direct Bonded Copper (DBC) material that includes a ceramic layer disposed between two copper layers. Such a carrier is particularly useful when the electrical component(s) located within the housing is a power component which generates substantial currents (e.g., hundreds of amps). In this case the ceramic layer provides good electrical insulation and thermal conductivity and the copper is able to carry the large currents.

Figure 8:
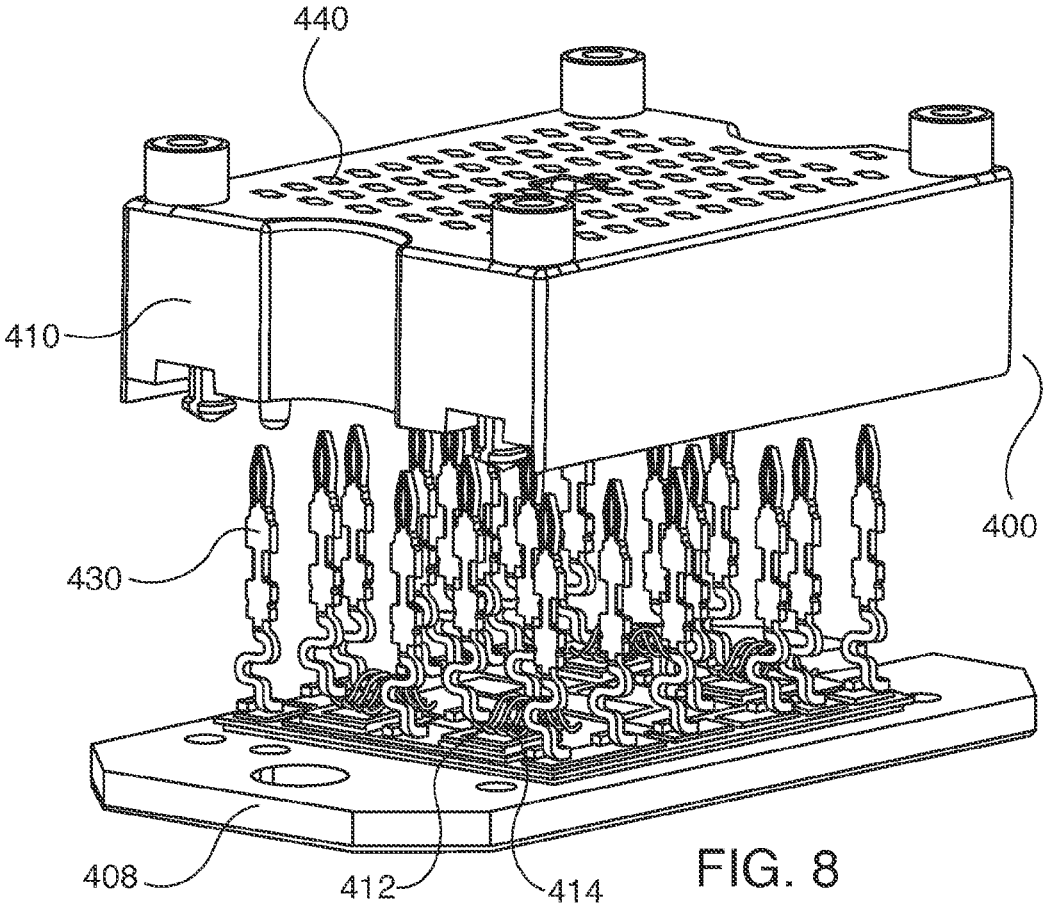
FIGS. 8-11 show one method that may be employed for assembling an electrical module. described above.

Housing 410 is placed over the press-fit pins so that the through-holes 440 are aligned with respective ones of the press-fit pins 430. Also shown in FIG. 8 are shown electrical components 412 (e.g., semiconductor dies), which are also secured to the carrier 408 and are electrically coupled to the one or more of the press-fit pins 430 via bonding wires 414.

Figure 9:
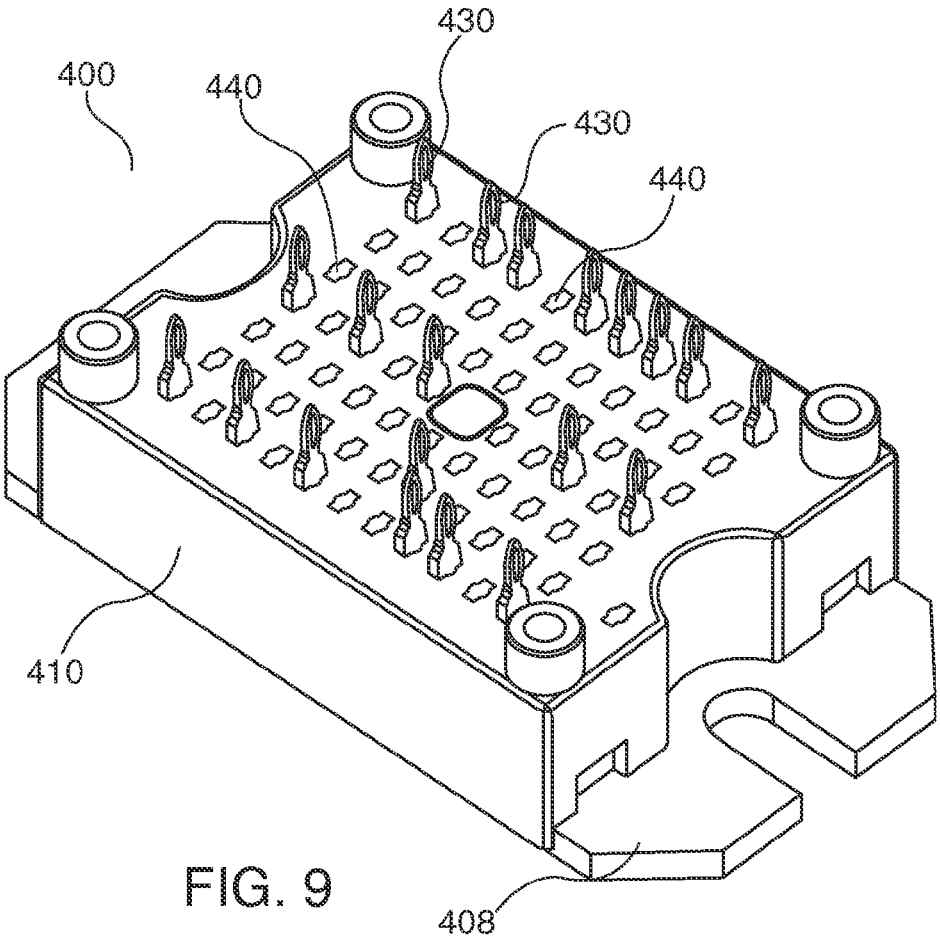

In FIG. 9 the press-fit pins 430 have been inserted through their respective through-holes 440 in the housing 410. As shown, the transverse axes of the press-fit pins 430 are aligned with with the maximum cross-sectional dimension of the through-holes 430, thereby allowing the press-fit pins 430 to conveniently pass through the through-holes 440. At this point the carrier 408 may be secured to the housing 410 using any suitable means such as screws, rivets and/or adhesive.

Figure 10:
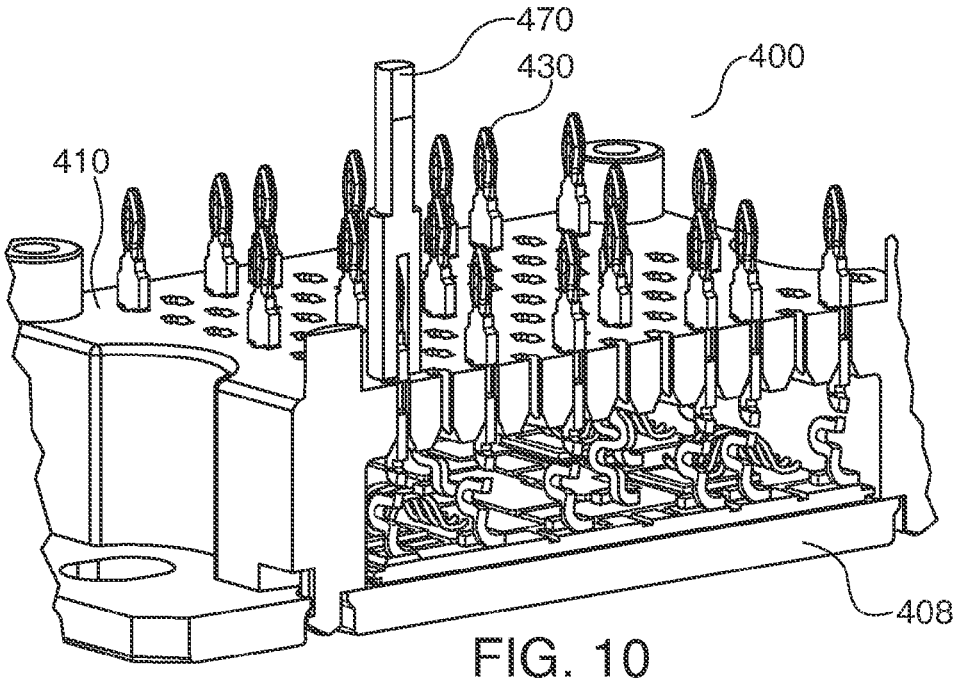

As shown in FIG. 10, a mechanical tool 470 is used to apply a rotational mechanical force to the exposed portion of the press-fit pins 430 to thereby twist the twistable portions of the pins 430. As a result, the pins 430 are locked in place and cannot be pushed into the housing by applying an excess longitudinally-directed force to the distal end of the press-fit pins 430. In the particular example shown, the mechanical tool 470 has a slit or cavity in which the press-fit portions and the shoulder portions of the press-fit pins 430 can be accommodated. Rotation of the mechanical tool 470 causes the twistable portions 244 the press-fit pins 430 to be twisted about the longitudinal axes of the press-fit pins 430. Of course, any suitable means may be used to twist the press-fit pins 430 into the proper orientation, including the manual rotation of the press-fit pins 430 by hand without the use of a mechanical tool.

Figure 11:
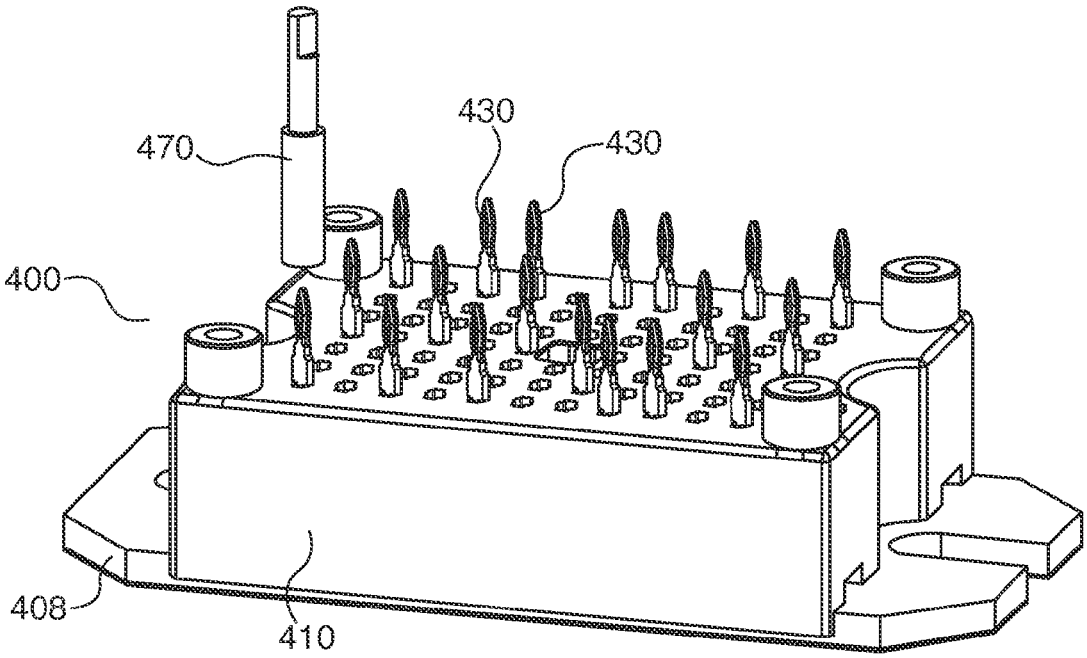

FIG. 11 shows the completed electrical module 400. In this example the press-fit portions and the shoulder portions of the press-fit pins 430 have been rotated by 45° from their original position. Of course, the press-fit portions and the shoulder portions of the press-fit pins 430 may be rotated by a different amount, provided that the press-fit pins 430 are locked in place so that they cannot be forced into the housing 410. Moreover, all of the press-fit pins 430 may or may not undergo a rotation by the same angular amount.

Figure 12:
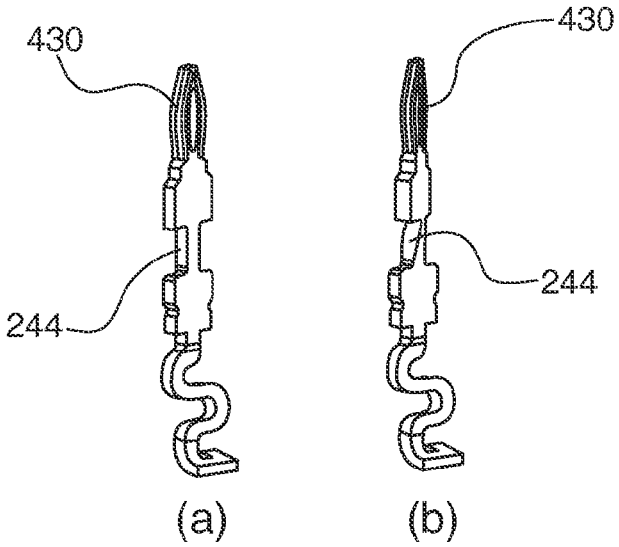
FIG. 12 shows the press-fit pin before being twisted (FIG. 12*a*) and after being twisted (FIG. 12*b*).

FIG. 12 shows the press-fit pin before being twisted (FIG. 12*a*) and after being twisted (FIG. 12*b*). The twist that is formed in the twistable portion 244 is clearly visible in FIG. 12*b*.

Figure 13:
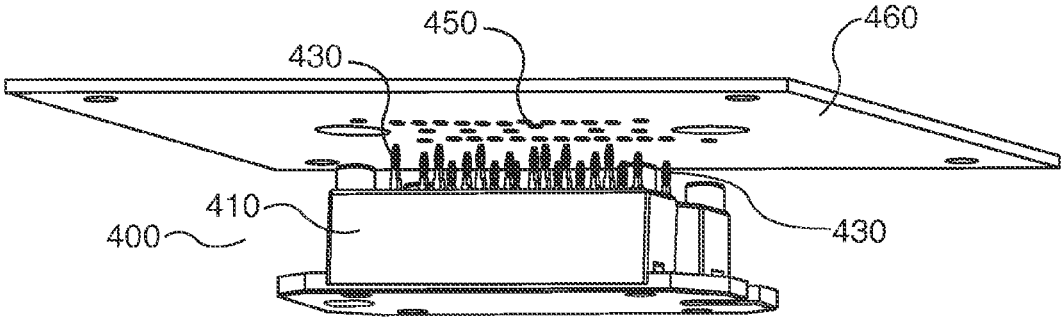
FIGS. 13-14 show the manner in which a completed electrical module of FIG. 11 is secured to a substrate such as a PC board.
Figure 14:
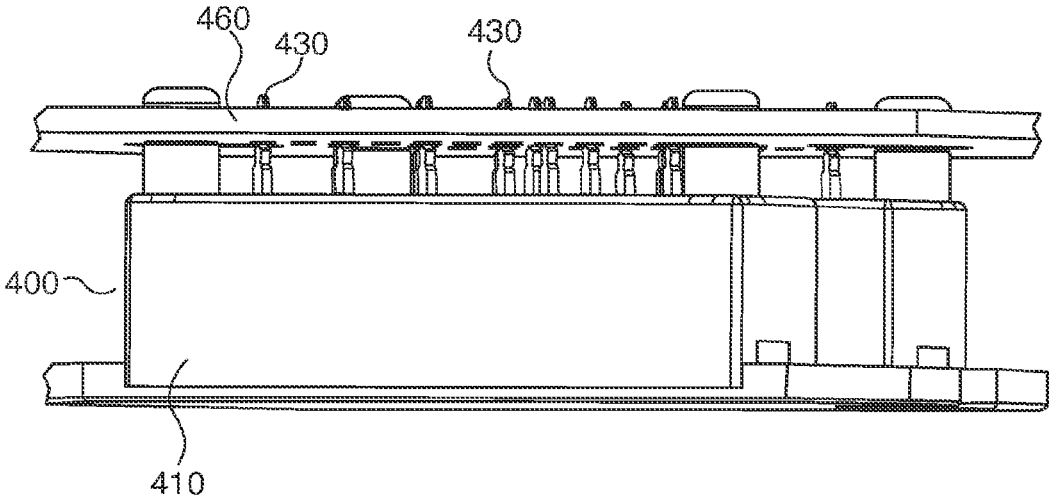

FIGS. 13-14 show the manner in which the completed electrical module 400 of FIG. 11 is secured to a substrate 460 such as a PC board. In FIG. 13 the press fit pins 430 are aligned with the through-holes 450 in PC board 460. Next, in FIG. 14, a force is applied to the upper surface of the PC board so that the press-fit portion of the press fit pins 430 are pushed through the through holes 450 with which they are respectively aligned to thereby establish the desired mechanical and electrical contact. Advantageously, because the press-fit pins 430 have been twisted as described above, the shoulder portion 242 prevents them from collapsing back into housing 410 because of the force exerted on them.

The invention claimed is:

1. An electrical module having at least one electrical press-fit contact, comprising a housing;

at least one electrical component mounted within the housing; and an electrical press-fit contact being located in part within the housing and having a press fit portion and a stop portion at its distal end and a mounting portion at its proximal end, the mourning portion being electrically coupled to the at least one electrical component, the press-fit and stop portions being located exterior of the housing such that the stop portion is able to block movement of the press-fit section into the housing when a press-in force is introduced onto the press-in contact to press the press-fit contact into the housing; wherein the press-fit contact is a press-fit pin and the housing has a surface with a through-hole formed therein, the press-fit pin having a longitudinal axis and a cross-sectional shape transverse to the longitudinal axis such that the through-hole only accommodates the press-fit portion and the stop portion of the press-fit pin in a single orientation when twisted about the longitudinal axis, the press-fit pin being twisted about the longitudinal axis so that it is not in the single orientation and cannot be fully accommodated by the through-hole.

2. The electrical module of claim 1 wherein the press-fit contact is a press-fit pin, the press-fit portion being configured to be insertable into a first through-hole of a carrier so that electrical contact is established with sidewalk defining the through-hole of the carrier.

3. The electrical module of claim 1 wherein the press-fit contact is a press-fit pin and the housing has a surface with a through-hole formed therein, the through-hole having a non-circular shape and the press-fit pin having a cross-sectional shape that is complementary to the non-circular shape of the through-hole such that the press-fit pin fits through the through-hole in a lock and key manner.

4. The electrical module of claim 3 wherein the press-fit pin is configured to be twistable into a locked position in which the stop portion is able to block movement of the press-fit portion through the through-hole while the mounting portion is electrically coupled to the at least one electrical component.

5. The electrical module of claim 1 wherein at least the press-fit portion and the stop portion of the press-fit pin are symmetric about the longitudinal axis.

6. The electrical module of claim 1 wherein the press-fit pin includes a twistable portion located proximal of the stop portion, the twistable portion being twistable so that the press-fit pin is not in the single orientation and cannot be fully accommodated by the through-hole.

7. The electrical module of claim 6 wherein remaining portions of the press-fit pin other than the twistable portion do not undergo twisting.

8. The electrical module of claim 1 wherein the press-fit pin further includes a stress relief portion providing elasticity to compensate for external forces applied to the press-fit pin.

9. The electrical module of claim 8 wherein the stress relief portion of the press-fit pin is located within the housing.

10. The electrical module of claim 1 wherein the press-fit portion has a slit therein extending in the longitudinal direction.

11. A method for assembling an electrical module having at least one press-fit contact, comprising:

mechanically and electrically securing a press-fit electrical contact to a mounting surface of a carrier portion of a housing, the carrier having at least one electrical component secured therein, the press-fit contact having a press-fit portion and a stop portion at its distal end and a mounting portion at its proximal end, the mounting portion being electrically coupled to the at least one electrical component;

inserting the distal end of the press-fit contact through a through-hole located in a surface of a second portion of the housing that mates with the carrier portion to form an interior space therein such that the press-fit portion and the stop portion are located exterior of the housing and at least the mounting portion is located in the interior of the housing; and applying a rotational force to at least the press-fit portion of the press-fit contact on that the stop portion is able to block movement of the press-fit section back through the through-hole in the surface of the housing when a press-in force is introduced onto the distal end of the press-in contact.

12. The method of claim 11 wherein applying the rotational force twists only a twistable portion of the press-fit electrical contact at a location proximal to that of the stop portion.

13. The method of claim 11 wherein the press-fit contact is a press-fit pin, the press-fit portion being configured to be insertable into a first through-hole of a carrier so that electrical contact is established with sidewalls defining the through-hole of the carrier.

14. The method of claim 11 wherein the press-fit contact is a press-fit pin and the housing has a surface with a through-hole formed therein, the through-hole having a non-circular shape and the press-fit pin having a cross-sectional shape that is complementary to the non-circular shape of the through-hole such that the press-fit pin fits through die through-hole in a lock and key manner.

15. The method of claim 13 wherein the press-fit pin is configured to be twistable into a locked position in which the stop portion is able to block movement of the press-fit portion through the through-hole while the mounting portion is electrically coupled to the at least one electrical component.

16. The method of claim 11 wherein the press-fit contact is a press-fit pin and the housing has a surface with a through-hole formed therein, the press-fit pin having a longitudinal axis and a cross-sectional shape transverse to the longitudinal axis such that the through-hole only accommodates the press-fit portion and the stop portion of the press-fit pin in a single orientation when twisted about the longitudinal axis, the press-fit pin being twisted about the longitudinal axis so that it is not in the single orientation and cannot be fully accommodated by the through-hole.

17. The method of claim 16 wherein at least the press-fit portion and the stop portion of the press-fit pin are symmetric about the longitudinal axis.

18. The method of claim 16 wherein the press-fit pin includes a twistable portion located proximal of the stop portion, the twistable portion being twistable so that the press-fit pin is not in the single orientation and cannot be fully accommodated by the through-hole.

19. The method of claim 18 wherein remaining portions of the press-fit pin other than the twistable portion do not undergo twisting.

20. The method of claim 11 wherein the press-fit pin further includes a stress relief portion providing elasticity to compensate for external forces applied to the press-fit pin.

21. The method of claim 11 wherein the press-fit portion has a slit therein extending in the longitudinal direction.

* * * * *